US005806690A

United States Patent [19]

Johnson et al.

[11] Patent Number: 5,806,690

[45] Date of Patent: Sep. 15, 1998

[54] ADJUSTABLE SHELVING

[75] Inventors: Terry Johnson, Chicago; Randy L. Johnson, Lake Forest, both of Ill.

[73] Assignee: Gamon International, Inc., Elk Grove Village, Ill.

[21] Appl. No.: 829,098

[22] Filed: Mar. 31, 1997

[51] Int. Cl.[6] ..... A47F 5/00

[52] U.S. Cl. ..... 211/59.3; 211/59.2; 211/175; 211/184; 211/194

[58] Field of Search ..... 211/59.3, 59.2, 211/175, 184, 194, 43, 188; 312/71

[56] References Cited

U.S. PATENT DOCUMENTS

| | | | |
|---|---|---|---|
| 4,685,574 | 8/1987 | Young et al. | 211/59.2 |
| 5,240,126 | 8/1993 | Foster et al. | 211/175 X |
| 5,366,099 | 11/1994 | Schmid | 211/184 X |
| 5,450,969 | 9/1995 | Johnson et al. | 21/59.3 |
| 5,542,552 | 8/1996 | Yablans et al. | 211/59.3 |
| 5,634,564 | 6/1997 | Spamer et al. | 211/175 X |
| 5,665,304 | 9/1997 | Heinen et al. | 211/59.3 X |
| 5,685,664 | 11/1997 | Parham et al. | 211/59.3 |

*Primary Examiner*—Robert W. Gibson, Jr.
*Attorney, Agent, or Firm*—Douglas B. White

[57] ABSTRACT

The display apparatus herein includes a length adjustable track upon which a spring biased movable plate travels. A friction lock is provided to secure the track at selected lengths and is incorporated into stacking supports for interconnecting an array of display units.

20 Claims, 5 Drawing Sheets

ADJUSTABLE SHELVING

BACKGROUND OF THE INVENTION

1. Field of the Invention

This invention relates generally to apparatus adapted to display product on shelves in a retail environment. More particularly, this invention relates to apparatus designed to maintain a stack of product on the shelf and to present it at the forward edge thereof.

2. Description of the Prior Art

Shelving display apparatus is commonly used to display product such as packaged food, and in such an apparatus, a spring-loaded plate typically rides on a track to apply forward pressure to a stack of product loaded therein. (A display of this type is shown in our prior U.S. Pat. No. 5,450,969.) One difficulty generally encountered with shelf display apparatus is that it must be constructed to fit shelving of specific predetermined depths. Since not all shelves are of the same depth, the need for an adjustable display has long existed. This adjustability, however, has been difficult to resolve due to the nature of the spring loaded mechanism and the need for the movable plate to pass smoothly over an adjustable joint.

SUMMARY OF THE INVENTION

It is therefore the primary objective of this invention to provide shelf display apparatus that is easily adjustable to varying depths. It is also an objective to provide means for locking the display at a selected depth. Finally, it is an object to provide means for interconnecting and stacking an array of adjustable display units.

The display apparatus herein includes an adjustable telescoping base track contoured to facilitate smooth travel of a spring biased movable plate. A friction lock is provided to lock the track at selected lengths and is incorporated into stacking supports for interconnecting an array of display units.

While the invention will be described in connection with a preferred embodiment, it will be understood that it is the intent to cover all alternatives, modifications, and equivalents as may be included within the spirit and scope of the invention as defined by the appended claims.

DESCRIPTION OF THE PREFERRED EMBODIMENT

Figure 1:
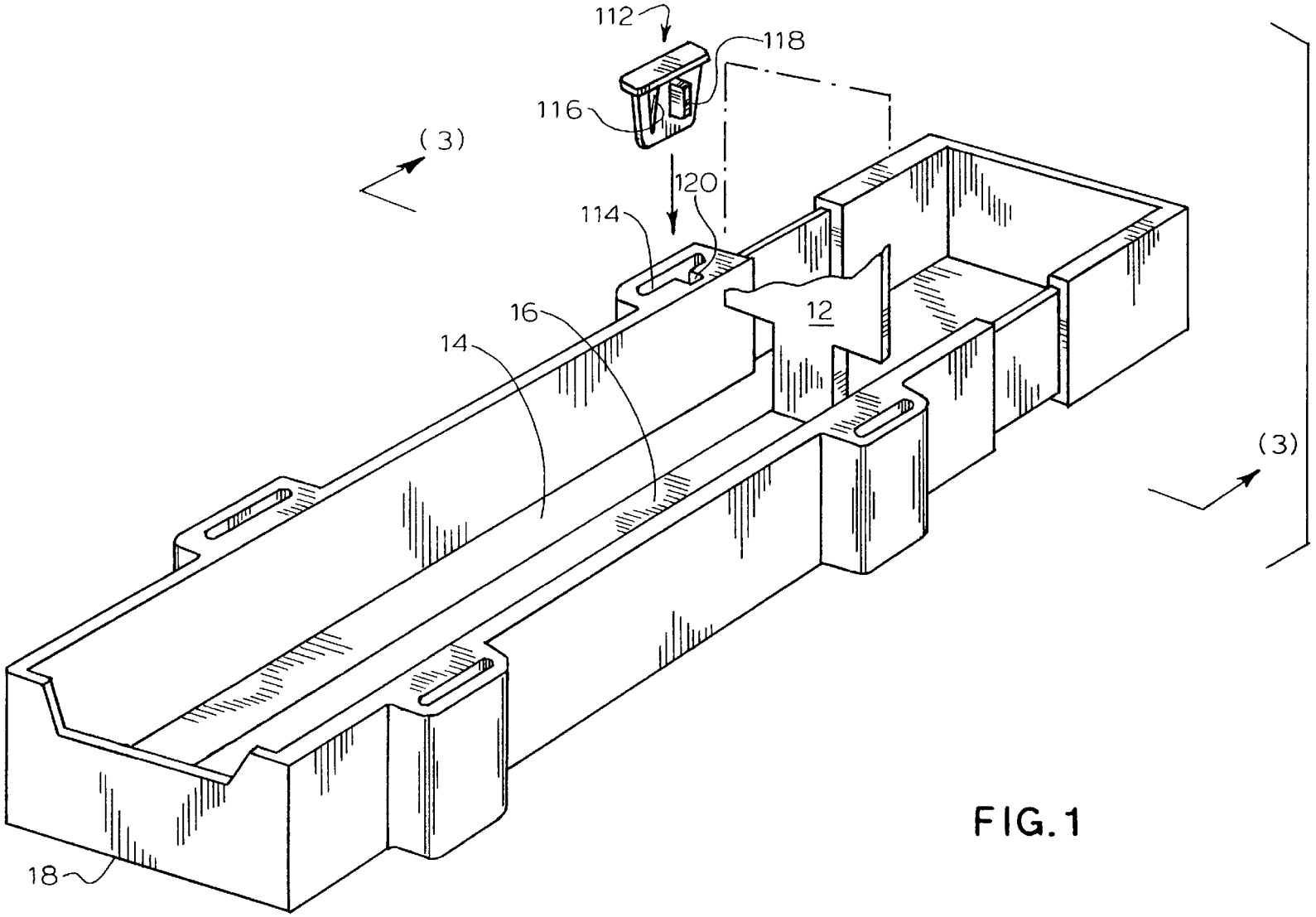
FIG. 1 is a perspective view of an adjustable shelving display apparatus in accordance with the present invention.

Turning first to FIG. 1 there is shown a perspective view of an adjustable display unit in accordance with the present invention. Particularly, a movable plate 12 is arranged to travel along a base track 14 to push forwardly a stack of inventory placed in front of the plate 12. A spring 16 is attached to the front 18 of the base and coils behind the movable plate, to urge the plate forwardly. (Greater detail on the forgoing is provided in our earlier U.S. Pat. No. 5,450,969, the present invention being an improvement thereon and that prior disclosure being incorporated herein by reference.)

Figure 2:
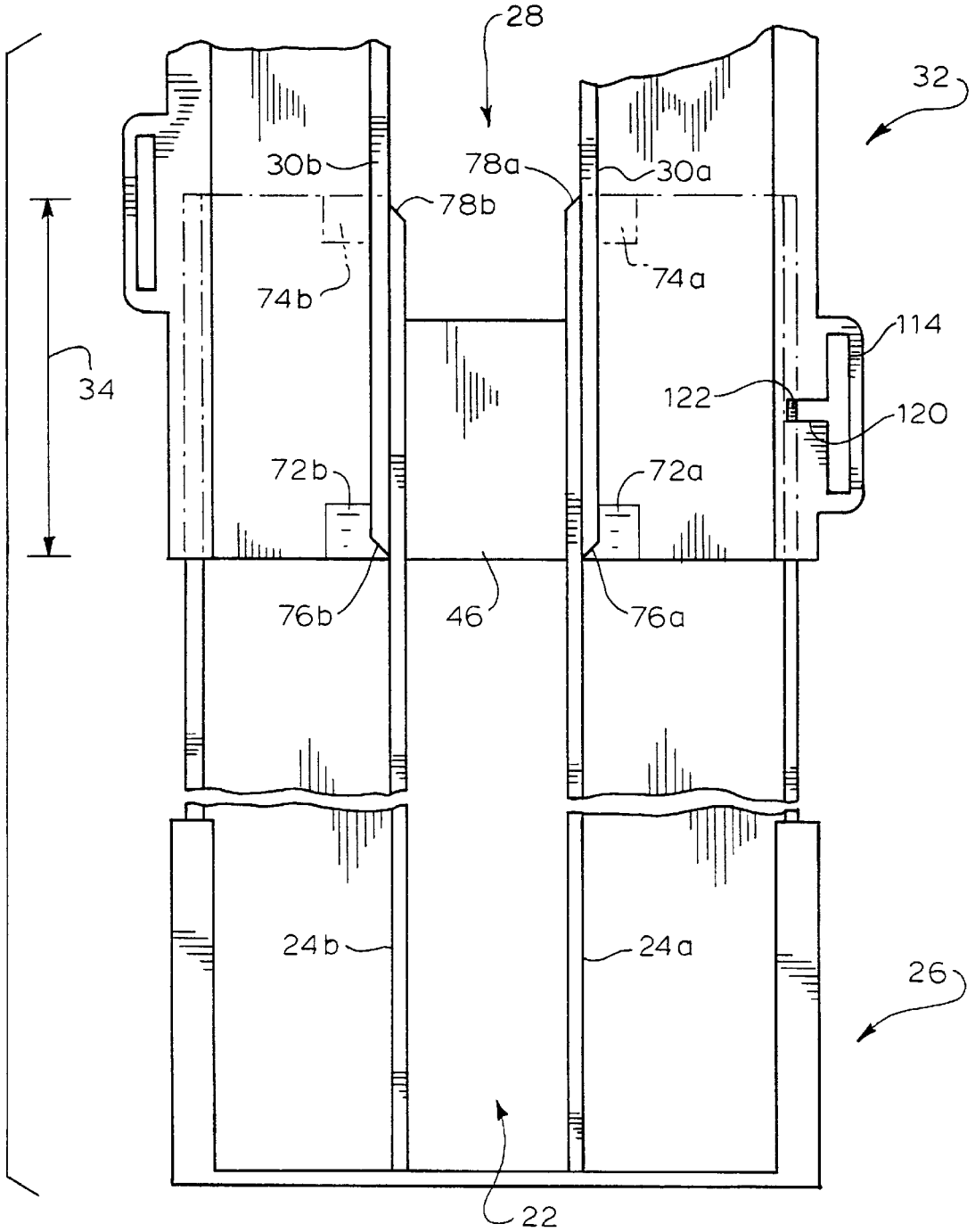
FIG. 2 is a top view of the track of FIG. 1 without the movable plate.
Figure 3:
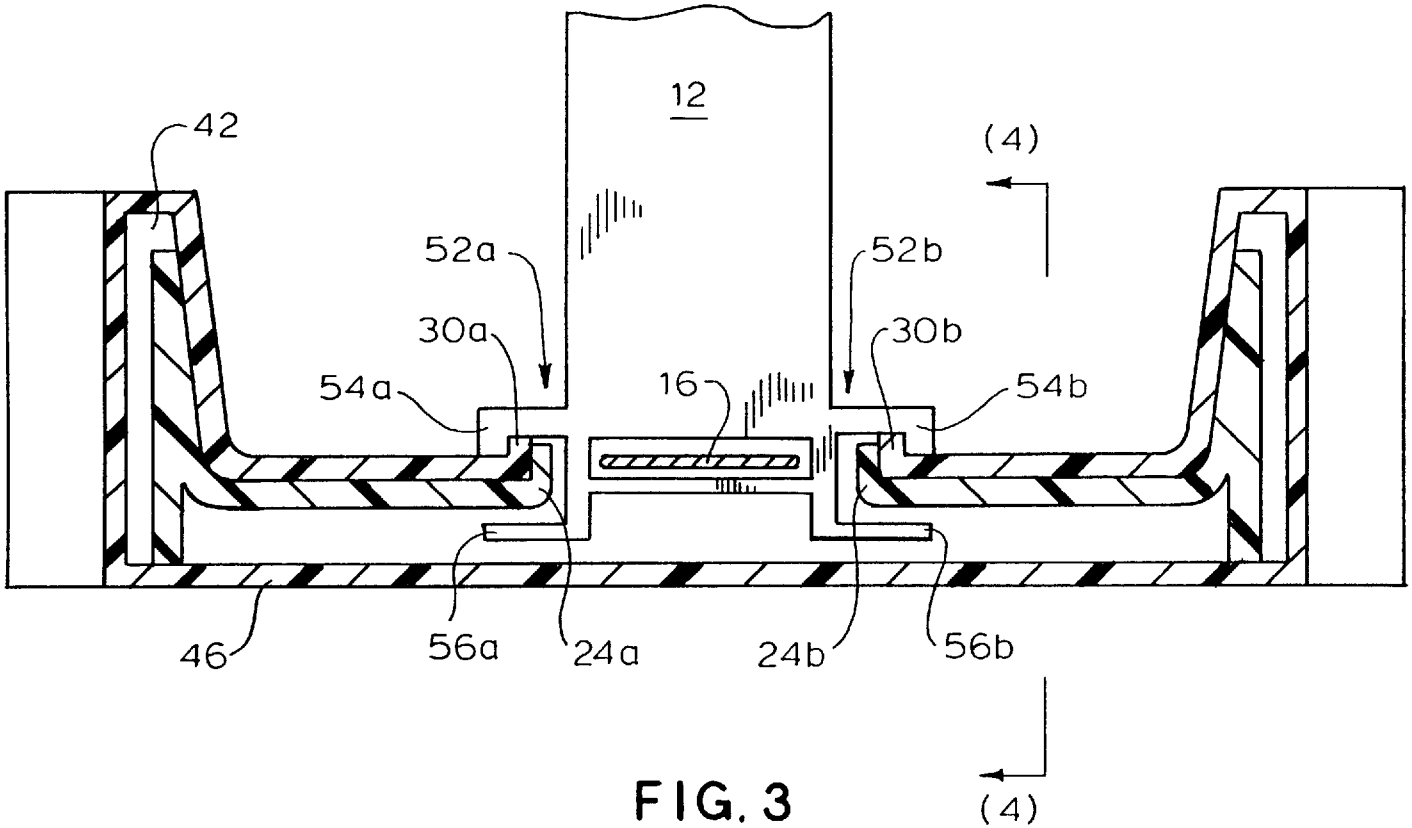
FIG. 3 is a cross-section of the apparatus of FIG. 1 taken along line 3—3 showing the supporting sleeve of the movable plate.

In the preferred embodiment of the improvement herein, there is provided a telescoping track formed by two base sections. Particularly, the track for the movable plate includes a slot 22 (FIG. 2) with rails 24*a* and 24*b* of the movable rearward base section 26 of the display unit. Similarly, a slot 28 with rails 30*a* and 30*b* forms the track in the stationary forward base section 32 of the display. The overall length of the track and the depth of the display unit is therefore controllable by the extent 34 that the rear section 26 telescopes into a channel 42 (FIG. 3) of the front section 32. As shown in FIG. 3, the stationary front section 32 exhibits a pair of channels 42 along opposing sides thereof. Into these channels respective sides of the rear section 26 ride to cause the sections to telescope together. Closing the bottom of the front section channels and holding the rear section within the channels is an under support member in the form of a cross brace 46 which spans the underside of the front section 32.

The movable plate member 12 engages the track slot at its respective base by means of dual sleeve members 52*a* and 52*b* (FIG. 3). These sleeve members present a channel with overhanging edges 54*a* and 54*b* to engage respective rails along the track slot, and underlying extensions 56*a* and 56*b* engage the underneath edge of the slot. Movement of the movable plate is accordingly constrained along the track slot, with the sleeve maintaining slot engagement throughout movement between the forward slot area 28, and the rear slot area 22.

Smooth transition across the telescoping joint is facilitated by way of smoothing contours. Specifically, miters 72*a* and 72*b* (FIG. 2) of the forward track section serve to ensure that the plate supporting sleeves move smoothly from the rear slot area 22 by lifting and guiding the overhanging edges 54*a* and 54*b* of the supporting sleeves during forward movement thereof. Similarly, when the movable plate is being moved rearwardly, miters 74*a* and 74*b* of the rearward base section serve to guide the underlying sleeve extensions through a smooth transition from the forward slot area 28. To prevent the supporting sleeves from catching against the rails during movement, rail miters 76*a* and 76*b* are provided on the rails of the front stationary base section and rail miters 78*a* and 78*b* are provided on the rails of the rear movable base section.

Figure 4:
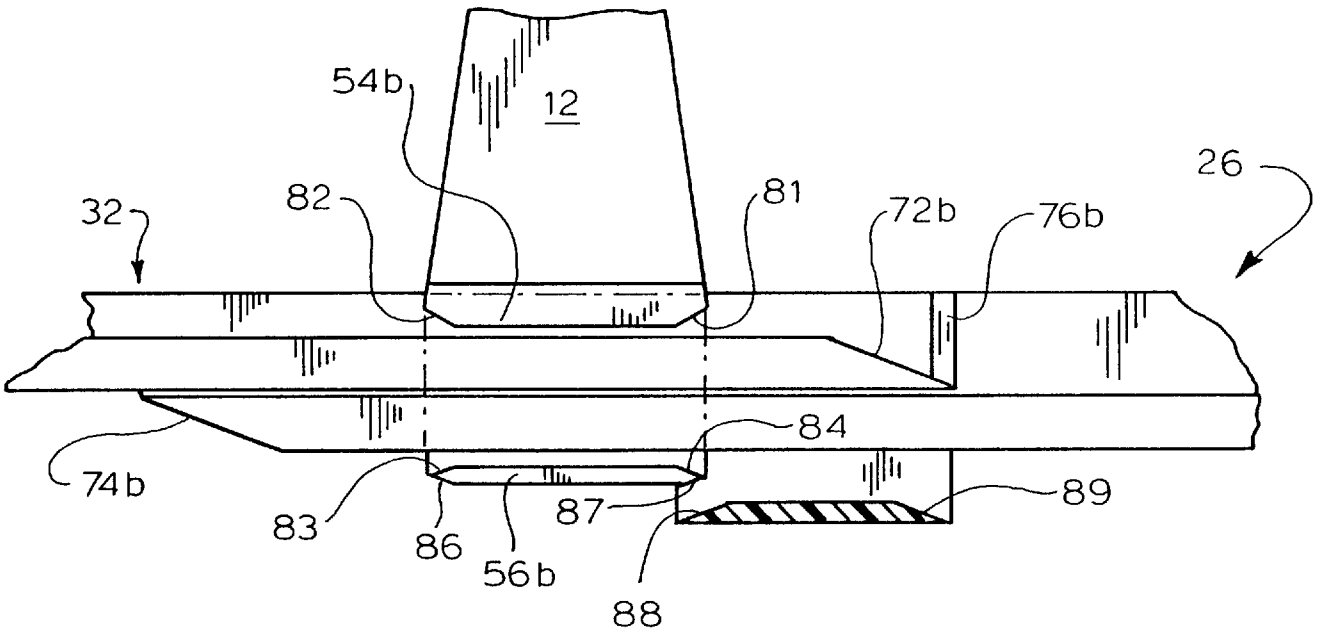
FIG. 4 is a cross-section of the apparatus taken along line 4—4 of FIG. 3 showing one of the supporting sleeves of the movable plate within the transition zone of the telescoping joint of the track.

The operation of the transition smoothing miters at the telescoping joint is best understood by reference to FIG. 4, in which there is illustrated the guiding miters 72*b* and 76*b* of the front section 32 to guide the edge 54*b* of the supporting sleeve from the rear section 26 to the front section 32. Similarly, the lower miter 74*b* serves to guide the under extension 56*b* of the sleeve; sleeve miters 81 and 82 are positioned to guide miter 72*b*; and sleeve miters 83 and 84 are positioned to guide miter 74*b*. Finally, the transition past the cross brace 46 is assisted by lower sleeve miters 86 and 87 positioned to be guided by cross brace miters 88 and 89.

Turning once again to FIG. 1, the telescoping base sections are adapted to be selectively secured at a desired extension by means of a locking member 112 arranged for insertion into a receptacle 114. This locking member has tapering ribs 116 defined thereon to frictionally hold the locking member in place when inserted into the slot 114. A rectangular locking tab 118 protrudes from the locking member and is arranged to slide into a cross slot receptacle 120 upon insertion of the locking member 112 into the slot 114. When so inserted, the locking tab 118 is forced against an exposed portion 122 of the rear section (FIG. 2) to frictionally secure and unify the front and rear sections.

Figure 5:
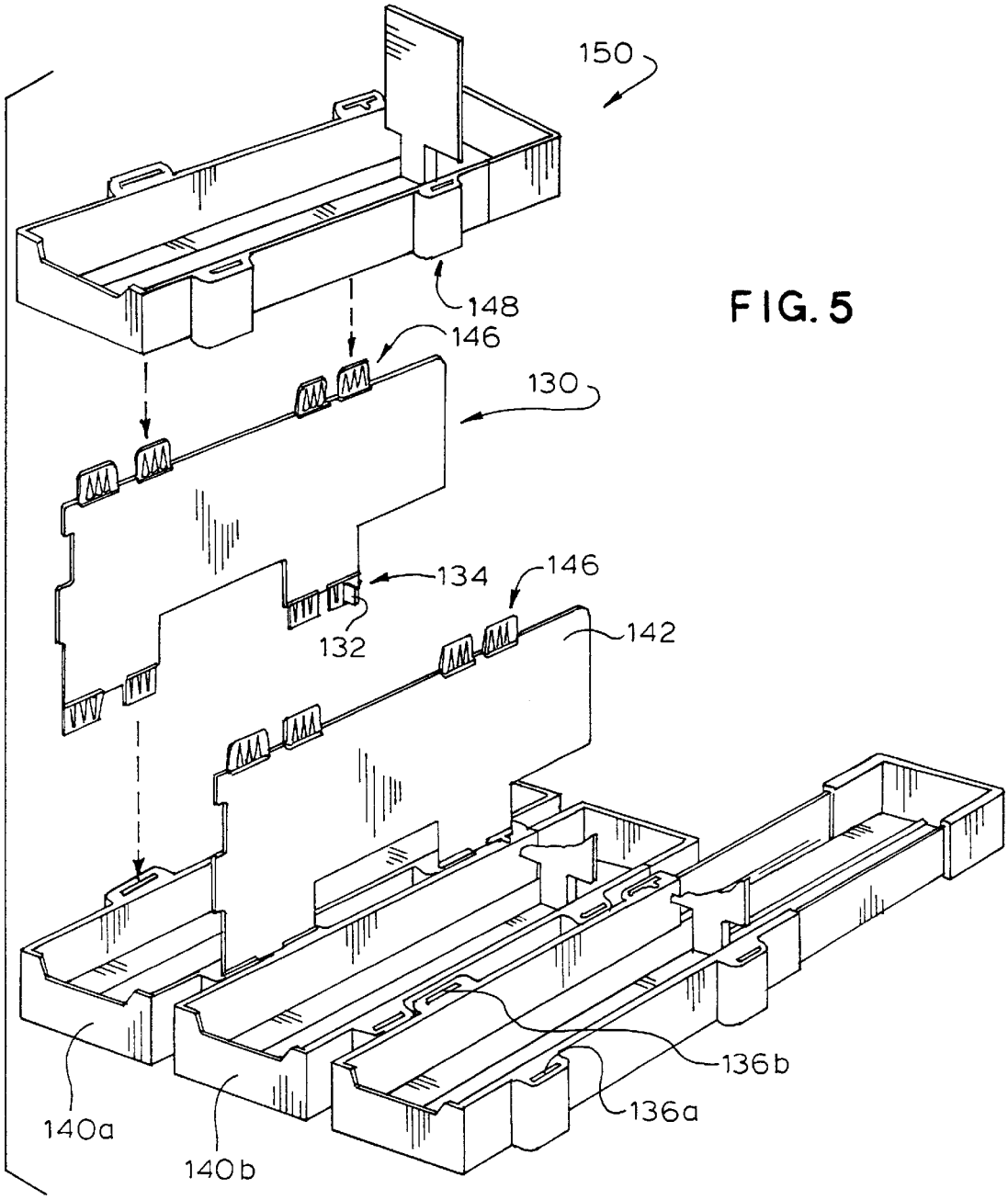
FIG. 5 is a perspective view of an array of multiple units of the shelving display apparatus being stacked and interconnected by means of a locking connector.

In a further feature (FIG. 5) for stacking display units, the locking device is incorporated into a stacking member 130, and a locking tab 132 is presented on one of the lower supporting feet 134 of the stacking member. The locking tab fits into a cross slot, as before, and the lower feet of the stacking member serve to vertically support the stacking member as well as to hold adjacent display units together. Particularly, a staggered disposition of slots 136*a* and 136*b* on the display units allows slots of adjacent units to line-up next to each other for receipt of the feet of the stacking member. Once a pair (140*a* and 140*b*) of display units are positioned together, the insertion of the stacking member 142 not only locks the telescoping sections of the unit 140*b* but also holds the pair of units 140*a* and 140*b* together. At the same time, the upper tabs 146 of the stacking member are positioned for insertion into similar staggered slots 148 positioned underneath an upper unit 150. With this arrangement, any desired number of adjustable units can be locked and stacked, horizontally and vertically, by means of these stacking members.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A shelving display comprising:

an adjustable base having a selectively adjustable length comprising a first base section including a channel, and a second base section including a portion arranged to ride within said channel of said first base section;

a movable plate member slidably engaged with said adjustable base;

means for urging said movable plate member forwardly; and locking means for securing said base at a selected length, comprising a receptacle defined in said first base section and an insert member for insertion into said receptacle for engaging said second base section.

2. The shelving display of claim 1 wherein said receptacle comprises a tab receiving slot and said insert member comprises a tab arranged to frictionally engage said second base section when inserted into said tab receiving slot.

3. The shelving display of claim 1 wherein said insert member frictionally engages said second base section.

4. The shelving display of claim 1 wherein said base further comprises a track slot defined along said base and said movable plate is supported on sleeves arranged to engage said track slot.

5. The shelving display of claim 4 further comprising rails defined along said track slot.

6. The shelving display of claim 5 further comprising an edge defined along said sleeves for engagement with said rails.

7. A shelving display comprising:

an adjustable base having a selectively adjustable length comprising a first base section exhibiting first and second channels positioned along opposing sides of said first base section, and a second base section including portions arranged to ride within said first and second channels of said first base section;

a movable plate member slidably engaged with said adjustable base;

means for urging said movable plate member forwardly; and locking means for securing said base at a selected length comprising a receptacle defined in said first base section and an insert member for insertion into said receptacle for engaging said second base section.

8. The shelving display of claim 7 wherein said insert member frictionally engages said second base section.

9. The shelving display of claim 7 wherein said receptacle comprises a tab receiving slot and said insert member comprises a tab arranged to frictionally engage said second base section when inserted into said tab receiving slot.

10. The shelving display of claim 7 wherein said base further comprises a track slot defined along said base and said movable plate is supported on sleeves arranged to engage said track slot.

11. The shelving display of claim 10 further comprising rails defined along said track slot.

12. The shelving display of claim 11 further comprising an edge defined along said sleeves for engagement with said rails.

13. A shelving display assembly comprising:

a plurality of adjustable bases, wherein each of said bases has a selectively adjustable length and wherein each of said adjustable bases each comprise a first base section including a channel and a second base section including a portion arranged to ride within said channel of said first base section;

a plurality of movable plate members, each slidably engaged with a respective base;

means for urging each of said movable plate members forwardly;

locking means for securing each of said bases at selected lengths comprising a receptacle defined in said first base sections and respective insert members for insertion into said receptacles for engaging said second base sections; and attachment means for securing proximate bases together.

14. The shelving display assembly of claim 13 wherein said respective insert members frictionally engage said respective second base sections.

15. The shelving display assembly of claim 13 wherein each of said receptacles comprise a tab receiving slot and each of said respective insert members comprise a tab arranged to frictionally engage said respective second base sections when inserted into said respective tab receiving slot.

16. The shelving display assembly of claim 13 wherein each of said adjustable bases comprises a respective track slot defined along said respective base and said respective movable plate is supported on sleeves arranged to engage said respective track slot.

17. The shelving display assembly of claim 16 further comprising rails defined along each of said respective track slots.

18. The shelving display assembly of claim 17 further comprising an edge defined along said sleeves of said respective movable plate for engagement with said respective rails.

19. The shelving display assembly of claim 13 wherein said first base sections each exhibit first and second channels positioned along opposing sides thereof, and said second base sections each include portions arranged to ride within said respective first and second channels of said respective first base sections.

20. The shelving display assembly of claim 19 wherein said respective insert members frictionally engage said respective second base sections.

* * * * *